US005810192A

United States Patent [19]

Cruz

[11] Patent Number: 5,810,192

[45] Date of Patent: Sep. 22, 1998

[54] ELONGATED SUSPENDED STORAGE DEVICE

[76] Inventor: Gail L. Cruz, 3069 Elstead Dr., Aubrun Hills, Mich. 48326

[21] Appl. No.: 691,936

[22] Filed: Aug. 5, 1996

[51] Int. Cl.[6] ..... B65D 25/22

[52] U.S. Cl. ..... 220/475; 220/740; 220/4.26; 220/23.4; 220/23.86

[58] Field of Search ..... 220/903, 740, 220/737, 475, 4.26, 916, 481, 480, 908, 751, 23.4, 23.83, 23.86; 248/205.2, 223.41, 224.51, 224.61

[56] References Cited

U.S. PATENT DOCUMENTS

| | | | |
|---|---|---|---|
| 863,893 | 8/1907 | Allan | 220/481 |
| 1,366,955 | 2/1921 | Schneible | 220/4.26 |
| 1,599,886 | 9/1926 | Graham | 220/481 |
| 2,972,407 | 2/1961 | Taylor | 220/4.26 |
| 3,899,098 | 8/1975 | Hutchins . | |
| 3,985,229 | 10/1976 | Maki | 220/23.4 |
| 4,517,815 | 5/1985 | Basso | 220/4.26 |
| 5,071,001 | 12/1991 | Ryman, III . | |
| 5,386,961 | 2/1995 | Lu | 248/223.41 |
| 5,425,196 | 6/1995 | Schwarze | 220/23.4 |

FOREIGN PATENT DOCUMENTS

| | | | |
|---|---|---|---|
| 717 368 | 2/1942 | Germany | 220/4.26 |
| 814 902 | 6/1959 | United Kingdom | 220/4.26 |

*Primary Examiner*—Stephen J. Castellano
*Attorney, Agent, or Firm*—Arnold S. Weintraub

[57] ABSTRACT

A device for storing empty soda pop cans or the like includes an elongated assembly defined by a plurality of interlocking and interconnectable sections which may be suspended from a stairway banister or the like. A flap or cover closes off each end of the device to prevent unwanted ejection of any containers stored therewithin. The container may include a locking member for interconnecting the device to a similar type of device in a depending manner therefrom.

10 Claims, 1 Drawing Sheet

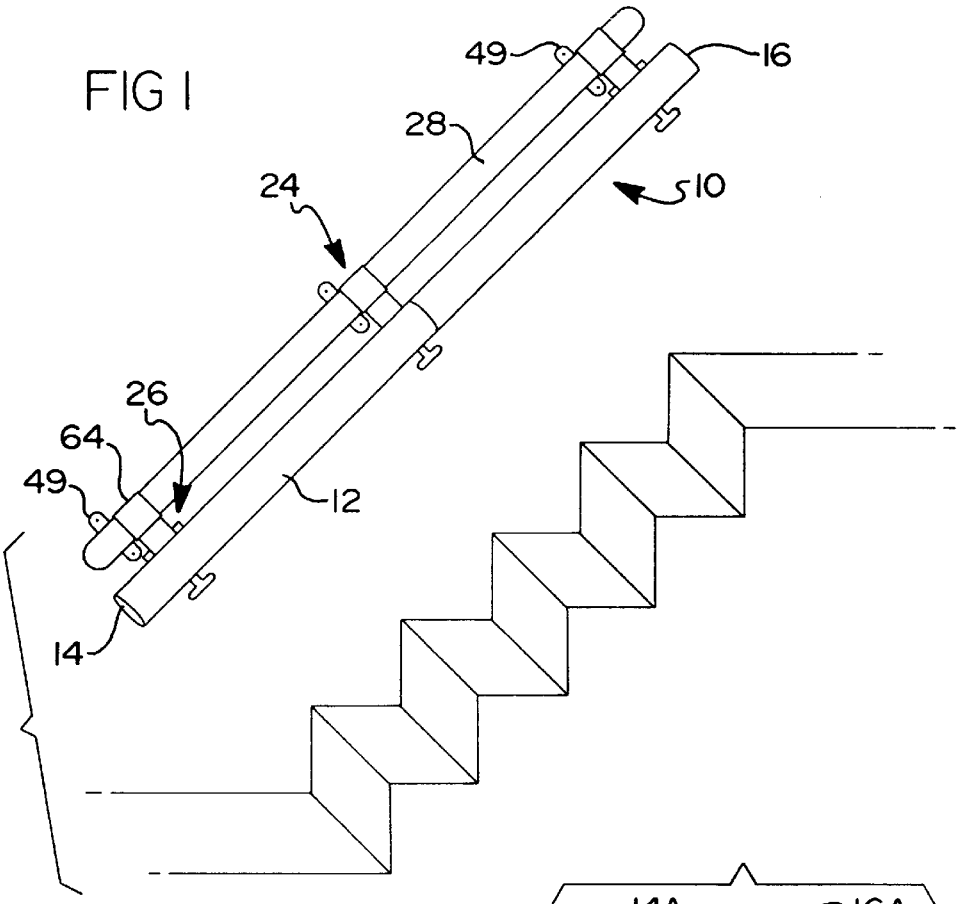
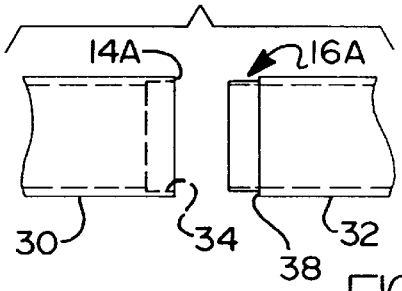
FIG 2
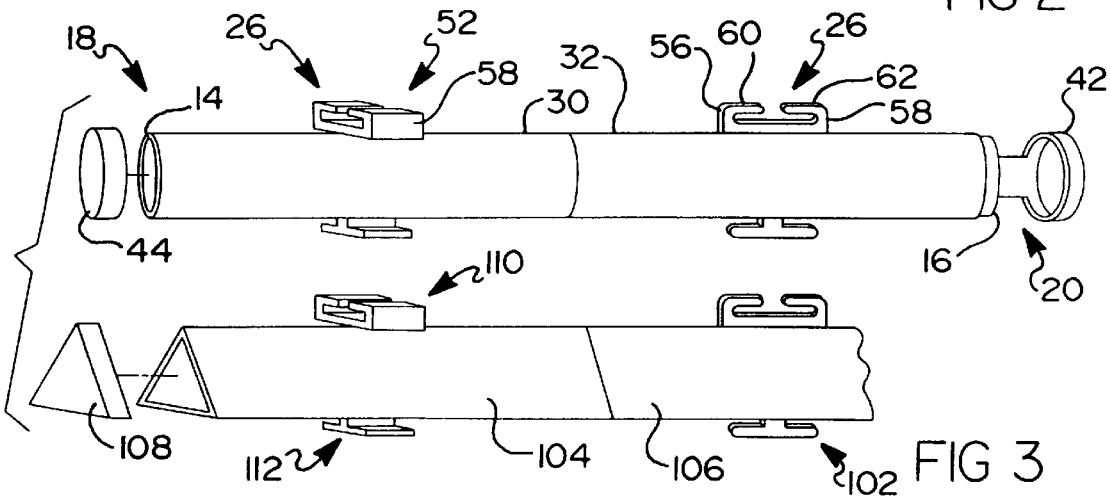
FIG 3

ELONGATED SUSPENDED STORAGE DEVICE

BACKGROUND OF THE INVENTION

1. Field of the Invention

The present invention relates generally to storage containers. More particularly, the present invention relates to multi-sectional storage containers. Even more particularly, the present invention pertains to containers that may be removably mounted to a stairway banister.

2. Description of the Prior Art

Several years ago, several states implemented bottle deposit legislation requiring the purchasers of beverage cans and bottles to pay "deposits" on the containers. The deposit has, thus, provided motivation for the purchasers to return the containers to a store to receive back the deposit. Typically, users accumulate these "returnable" containers and return a collected quantity of such at one time. As such, many people keep their returnables stored throughout their homes until such time as they return them. It is not unusual for bottles and cans to be stored in many locations throughout peoples' homes. Often, the containers are stored in large plastic bags or the like and are left in the garage or other open area where they are unsightly and may pose a danger to small children. In any event, the collection of returnable containers create, at least, in unsightly and inconvenient collection problem.

To date, there has been no convenient "hidden" location for storing returnable and/or recyclable containers which is available to most users. Thus, the art seeks a device that may serve to store not only used, but unused cans and bottles such that they are out of sight. Additionally what is needed is a storage side that may be enlarged or expanded depending upon the number of cans, bottles or other items to be stored therein. It is to this end to which the present invention is directed.

SUMMARY OF THE INVENTION

In accordance with the present invention there is provided a storage device for removably storing therewithin cylindrical containers and the like and which is particularly adapted for securement to a stairway banister or the like.

The present invention, generally, comprises:

(a) one elongated or, preferably, at least a pair of interconnectable, hollow, tubular members adapted to be in registry with each other, (b) means for interconnecting the at least two tubular members, and (c) means for connecting the tubular members to a support member.

When interconnected, the tubular members cooperate to define an open-ended elongated tubular element.

A cap or flap or similar means for closing off the ends of the flaps to prevent unwanted ejection of items stored within the tubular members is associated with the open ends.

In a particularly preferred embodiment hereof, a multi-sectional elongated tubular member is defined by a plurality of interlocking registerable tubular sections to define a substantially hollow container storage device. Means for closing each end of the container, such as a cap or flap or the like is used to seal off the ends to prevent items stored within the device from falling therethrough.

The present invention further contemplates means for mounting the device to a stairway banister or similar support member or device.

At least one of the sections includes means for interconnecting the at least one section to another storage device which is suspendingly dependent therefrom.

For a more complete understanding of the present invention, reference is made to the following detailed description and accompanying drawings. In the drawing like reference characters referred to like parts throughout the several view in which:

BRIEF DESCRIPTION OF THE DRAWING

FIG. 1 is an environmental view of a storage device in accordance with the present invention;

FIG. 2 is a broken, exploded plan view showing the interconnection between at least two sections of the storage device hereof; and FIG. 3 is an exploded partially, broken, plan view showing the suspended interconnection between two storage devices.

DESCRIPTION OF THE PREFERRED EMBODIMENT

Now, with reference to the drawing and in accordance with the present invention there is provided a storage device or member, generally, denoted at 10 and which comprises (a) a hollow elongated tubular member 12 having a first end 14 and a second end 16, (b) means 18 for closing the first end, (c) means 20 for closing the second end, and (c) means 24 for suspending the container 12 from a support. Preferably, the support is angularly inclined with respect to the horizontal plane, such as a stairway or rail banister 28 or the like.

The present invention further contemplates means, generally, denoted at 26, for interconnecting the device to a second device which suspendingly depends therefrom.

More particularly, and as shown in the drawing, the elongated member 12, preferably, comprises at least a pair of separable telescopingly or otherwise interconnectable sections 30, 32. The sections 30, 32 are telescopingly interconnectable via any suitable means. For example, and as shown in FIG. 2, a first end 14*a* of the section 30 may have a reduced diameter portion 34 which projects and telescopes into a mating end 16*a* of the section 32. The section 32 has a shoulder 38 which abuts against the flange or shoulder 35 defined by the terminus of the reduced diameter portion of the section 30, in the well known manner. By providing the telescoping interconnection, there is provided the elongated container 12. The inner diameter of each section 30, 32 are substantially equal so that there is registry between the interior of the sections and a passage is provided between the sections.

Other means for achieving interconnection may also be used, such as threaded interconnection or the like. What is essential hereto, however, is that there be at least two interconnectable sections which cooperate together to define a hollow interior assembly which may be used to store beverage cans, bottles and similar containers or the like.

As shown in FIG. 3 and as noted hereinabove, the first and second ends 14, 16 of the device 10 each have means 20 for sealingly closing their respective associated free ends. Thus, for example, a hinged flap 42 may be integrally formed or otherwise associated with its associated first and/or second end. The flap, is preferably, integrally formed with its associated section. Alternatively, the means for closing may comprise a separable piece or cap or cover 44 which removably fits over and encloses the associated free end of the section to prevent unwanted ejection of an item stored within the device.

Referring, now, particularly to FIG. 3 and as noted hereinabove, the present invention further includes means 24 for suspending the device 10 from a support 28. The support 28, preferably, comprises a stairway or rail banister or similar support which is angularly inclined with respect to the horizontal plane. Any suitable means, such as a clamp (not shown), a U-bolt (not shown) or the like may be used to suspend the sections of the device from the banister. However, and as shown in FIG. 3, and in a particularly preferred embodiment hereof, each section of the device 10 includes at least one keyway 52 integrally formed therewith. The keyway includes a base 54 and a pair of opposed, spaced apart upwardly extending side walls 56, 58. Legs 60, 62 are, each, integrally formed with an associated side wall and are inwardly directed towards each other and overlie a predetermined space above the base. Thus, the keyway defines a "T-slot". A strap 64 or the like may then be threaded through the keyway 52 and wrapped upon itself over the banister, as shown, to suspend the device therefrom.

Preferably, the strap 64 is a hook and loop type fastening strap, such as a Velcro strap which can be laced through the keyway 52 and then wrapped back upon itself in a well known manner to suspend the device from the banister 28.

The keyway 52 may also be used to interconnect or lock a second storage device 102 dependingly therefrom. Thus, and in accordance herewith and in a further embodiment of the present invention and as shown in FIG. 3 there is provided a plurality of storage devices, respectively, denoted at 10, 102. Each device is similarly constructed as comprising a plurality of telescoping interconnectable or otherwise sections (30, 32 of device 10 and 104, 106 of device 102) as heretofore described including end caps, two being shown at 44 and 108. Each device 10 or 102 defines a substantially hollow member of any desired configuration. In the embodiment shown in the drawing, the first container 10 is depicted as a hollow tubular cylindrical member, the container 102 is depicted as a triangular hollowed interior member which may be used to removably store therewithin fishing poles or the like. Of course, any other configuration such as rectangular, cylindrical hexagonal, etc., may be used.

Herein, the device 102 includes at least one keyway of the type heretofore described and, generally, denoted at 110. The keyway 110 is disposed at a first position exteriorly of the section. Diametrically opposed to the keyway 110 is a locking member 112 which is complementarily configured to the shape of the keyway 110. In this manner, the locking member or "T" may be slidingly insertably disposed within a keyway of another section to interlock, in depending or suspended fashion, one device to another. Each section of each container comprises at least one keyway and one diametrically opposed locking member, as shown.

As hereinabove noted and as contemplated in the practice of the present invention the substantially cylindrical hollow container is used to store therewithin empty or full beverage containers therewith. By storing the beverage containers within the container their unsightly collection is prevented. When it is desired to empty the container, the flap 42 or end cap 44 is simply removed therefrom. By virtue of the angular disposition, in substantial parallelism to the banister, the empty or full containers will slide out of the device into a suitable receptacle (not shown) for transport or other disposal.

The sections of the device hereof may be formed from any suitable material such as a plastic, lightweight metal or the like. Preferably, a lightweight, durable plastic is used as the material of construction.

It is to be appreciated from the preceding that there is provided a storage system which utilizes previously unused areas and/or spaces and which removes from visibility unsightly empty containers or the like.

Having, thus, described the invention what is claimed is:

1. A storage device for removably storing items therewithin, comprising:

a first elongated tubular member comprising:

(a) at least a pair of hollow interior interconnectable sections cooperating to define a passage therethrough, each of the sections having a free open end and an opposed connecting open end;

(b) means for interconnecting the sections at the connecting open ends thereof to define the first elongated tubular member, the free open ends of the sections defining free open ends of the first elongated tubular member;

(c) first means for suspending the first elongated tubular member from a support; and (d) second means for suspending a second elongated tubular member from the first elongated tubular member.

2. The storage device of claim 1, further comprising:

(a) at least one keyway disposed exteriorly on each section;

(b) at least one locking member complementarily configured to the at least one keyway and disposed exteriorly on each section; and wherein the at least one locking member of the first elongated tubular member is adapted to lock in a keyway of a second elongated tubular member to cooperate therewith to define the second means for suspending.

3. The storage device of claim 2 wherein:

(a) the at least one keyway has a T-shaped slot formed therein;

(b) the at least one locking member is a T-shaped member; and further wherein the at least one locking member is adapted to slidably insert in a slot of a second elongated tubular member.

4. The storage device of claim 1, further comprising: means for suspending the device from an inclined rail banister substantially parallel thereto.

5. The device of claim 1, further comprising:

a second elongated tubular member suspended from the first elongated tubular member.

6. The device of claim 5 wherein the second elongated tubular member comprises:

(a) at least a pair of hollow interior interconnectable sections, each of the sections having a free open end and an opposed connecting open end;

(b) means for interconnecting the sections at the connecting open ends thereof to define the second elongated tubular member, the free open ends of the sections defining free open ends of the second elongated tubular member;

(c) first means for suspending the second elongated tubular member from the first elongated tubular member; and (d) second means for suspending a third elongated tubular member from the second elongated tubular member.

7. The device of claim 1 further comprising:

means for intermittently sealingly closing the free open ends of the first elongated tubular member.

8. In combination:

(a) a storage device for removably storing items therewithin, the storage device comprising:

a first elongated tubular member comprising:

(1) at least a pair of hollow interior interconnectable sections, each of the sections having a free open end and an opposed connecting open end;

(2) means for interconnecting the sections at the connecting open ends thereof to define the first elongated tubular member, the free open ends of the sections defining free open ends of the first elongated tubular member;

(3) first means for suspending the first elongated tubular member from a support;

(4) second means for suspending a second elongated tubular member from the first elongated tubular member;

(b) a rail banister adapted to be mounted to a wall; and wherein the rail banister is the support, the storage device being disposed substantially parallel thereto.

9. The combination of claims 8, further comprising:

(a) at least one keyway disposed exteriorly on each section of each of the storage devices;

(b) at least one locking member complementarily configured to the at least one keyway and disposed exteriorly on each section; and wherein the at least one locking member of the first elongated tubular member is adapted to lock in a keyway of a second elongated tubular member to cooperate therewith to define the second means for suspending.

10. The combination of claim 9 wherein:

(a) the at least one keyway has a T-shaped slot formed therein;

(b) the at least one locking member is a T-shaped member; and further wherein the at least one locking member is slidably insertable in a slot of a second elongated storage member.

* * * * *